US005176541A

United States Patent [19]

Mori

[11] Patent Number: 5,176,541

[45] Date of Patent: Jan. 5, 1993

[54] ELECTRICAL CONNECTION AND METHOD OF MAKING SAME

[75] Inventor: Satoshi Mori, Tokyo, Japan

[73] Assignee: Hirose Electric Co., Ltd., Tokyo, Japan

[21] Appl. No.: 792,615

[22] Filed: Nov. 15, 1991

[30] Foreign Application Priority Data

Nov. 15, 1990 [JP] Japan ..... 2-307274

[51] Int. Cl.[5] ..... H01R 13/405

[52] U.S. Cl. ..... 439/736; 439/660

[58] Field of Search ..... 439/736, 636, 637, 722, 439/606, 660

[56] References Cited

U.S. PATENT DOCUMENTS

| | | | |
|---|---|---|---|
| 4,106,841 | 8/1978 | Vladic | 439/637 |
| 4,501,465 | 2/1985 | Hoshino et al. | 439/736 |
| 4,863,402 | 9/1989 | Black et al. | 439/736 |

*Primary Examiner*—David L. Pirlot
*Attorney, Agent, or Firm*—Kanesaka & Takeuchi

[57] ABSTRACT

An electrical connector includes an insulating case (3) having a pair of support walls (5, 6) extending upwardly from a bottom thereof; and a plurality of terminals (7, 8) having a crank portion (10*b*, 11*b*) integrally molded within the insulating case such that contact portions of the terminals are exposed from the insides of the support walls. A method of making an electrical connector includes joining a pair of slide molds (16, 17) with a lower mold (15) to hold leg portions of terminals (7, 8); setting an upper mold (14) in the slide molds so as to insert a protruded portion (18) of the upper mold between the slide molds so that terminal guides (34, 44) abut on the protruded portion to form a mold cavity and terminal holders (36, 46) in which the terminals are held, and injecting a molding material into the mold cavity to mold an electrical connector.

2 Claims, 5 Drawing Sheets

ELECTRICAL CONNECTION AND METHOD OF MAKING SAME

BACKGROUND OF THE INVENTION

1. Field of the Invention

The present invention relates to electrical connectors for electronic equipment and method of making the same.

2. Description of the Prior Art

FIG. 10 shows a conventional electrical connector which includes an insulating case 50 having a fitting cavity 51. A number of terminal channels 52 are formed on opposite inside walls of the insulating case 50 with a predetermined pitch. A number of press-fit apertures 53 are formed on the bottom of the insulating case 50 so as to communicate with the terminal channels 52. A number of terminals 54 are press fitted into the press-fit apertures 53 such that the contact portions 55 of the terminals 54 are placed in the terminal channels 52. Thus, the terminals 54 are secured to the insulating case 50.

However, it is necessary to not only press fit the terminals into the insulating case 50 but also provide a means for blocking flows of flux.

FIGS. 11–13 shows another conventional electrical connector which includes an insulating case 55', terminals insulating case 55' to provide a molded component 56, and an insulating case 50 identical with the aforementioned insulating case 50. The molded component 56 is joined with the insulating case 50 such that the terminals 54 are fitted into the press-fit apertures 53 of the insulating case 50 while the contact portions 55 of the terminals 54 are placed in the terminal channels 52.

However, it is necessary to provide both the molded component 56 and the insulating case 50, resulting in the increased number of assembly steps and the increased manufacturing costs.

FIG. 14 shows how to make a still another conventional electrical connector which includes the steps of holding the legs of terminals 54 between a lower mold 57 and slide molds 58 or 59, setting an upper mold 60 such that its protruded portion 61 is placed between the terminals 54, and injecting a molding material into the mold cavity 62 for making a molding.

However, the terminals 54 are not supported on the outside and can move outwardly and/or sideways so that the terminal 54 is embedded in the insulating case 63 as shown in FIG. 21.

SUMMARY OF THE INVENTION

Accordingly, it is an object of the invention to provide an electrical connector which needs neither press-fit process nor any means for blocking flows of flux.

It is another object of the invention to provide an electrical connector which has a one-piece molded component, thereby reducing the number of components and process steps, thus minimizing the manufacturing costs.

It is a still another object of the invention to provide a method of making an electrical connector which makes it possible to prevent the terminals from moving outwardly and/or sideways, thereby not only preventing the terminals from being embedded within the insulating case but also providing precise terminal pitch.

According to one aspect of the invention there is provided an electrical connector which includes an insulating case having a pair of support walls; and a plurality of terminals integrally molded with the insulating case such that contact portions of the terminals are exposed on the insides of the support walls.

According to another aspect of the invention there is provided a method of making an electrical connector which includes the steps of joining a pair of slide molds with a lower mold to hold leg portions of terminals; setting an upper mold in the slide molds so as to insert a protruded portion of the upper mold between the slide molds so that terminal guides abut on the protruded portion to form terminal holders in which the terminals are held, and injecting a molding material into a mold cavity to mold an electrical connector.

The above and other objects, features, and advantages of the invention will become more apparent from the following description when taken in conjunction with the accompanying drawings.

DESCRIPTION OF THE PREFERRED EMBODIMENT

Figure 1:
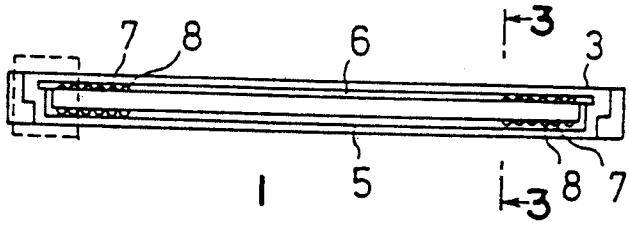
FIG. 1 is a top plan view of an electrical connector according to an embodiment of the invention.
Figure 2:
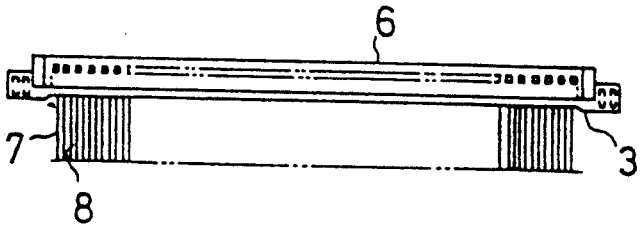
FIG. 2 is a front elevational view of the electrical connector.
Figure 3:
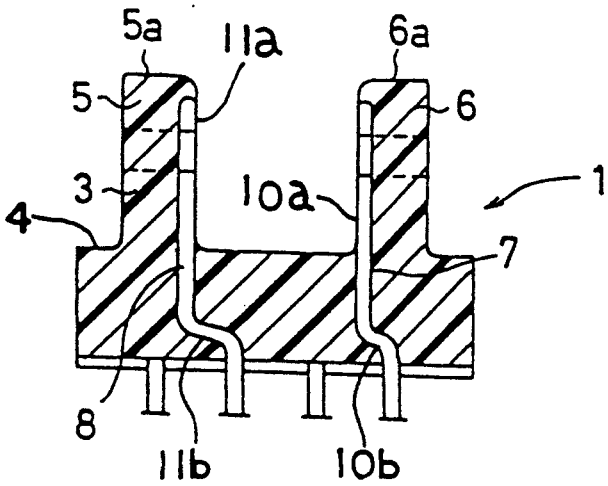
FIG. 3 is a sectional view taken along line 3—3 of FIG. 2.

In FIGS. 1–3, a connector plug 1 includes an insulating case 3 which is made from a plastic, such as polyamide resin, PBT, or LCP, in the form of a substantially rectangular prism. A pair of supporting walls 5 and 6 extend upwardly from the base 4 of the insulating case 3. A number of terminals 7 and 8 are attached to the insulating case 3 such that their crank portions **11*a* and 11*b* are embedded in the insulating case 3 by an insert molding process while the contact portions 10*a* and 10*b* of the terminals 7 and 8 placed on the inside of the support walls 5 and 6** so that they face each other.

Figure 4:
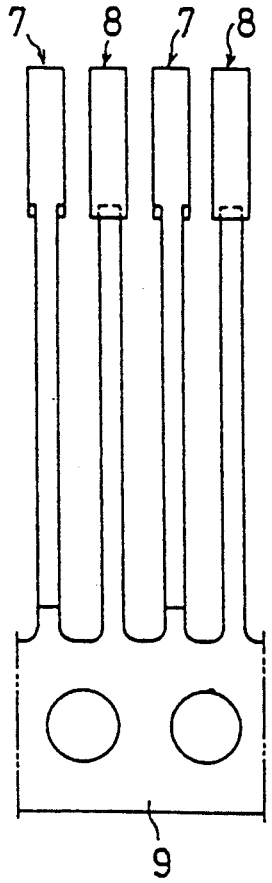
FIG. 4 is a top plan view of electrical terminals useful for the electrical connector.
Figure 5:
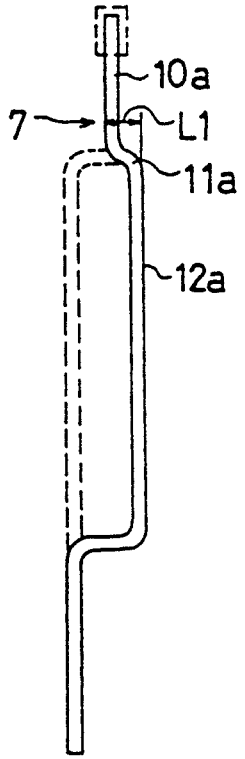
FIG. 5 is a side view of the electrical terminal with a short crank portion.
Figure 6:
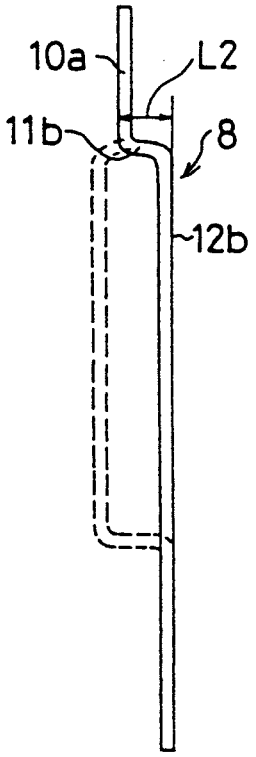
FIG. 6 is a side view of the electrical terminal with a long crank portion.

In FIGS. 4–6, the terminals 5 and 6 are stamped integrally with a carrier 9 from a phosphorus brass strip in a multistage continuous press and plated with gold. The terminal 7 or 8 has a contact portion **10*a* or 10*b*, a crank portion 11*a* or 11*b*, and a leg portion 12*a* or 12*b*. The length L2 of the crank portion 11***b* of a terminal 8 is made greater than the length L1 of a terminal 7.

Figure 9:
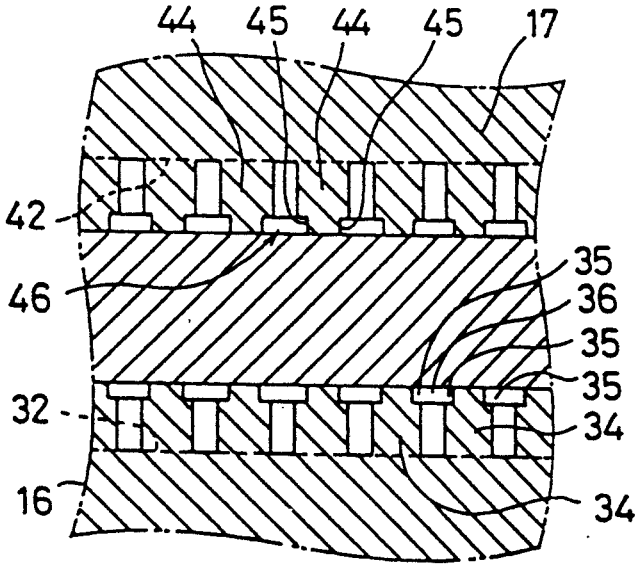
FIG. 9 is a sectional view taken along line 9—9 of FIG. 7.
Figure 7:
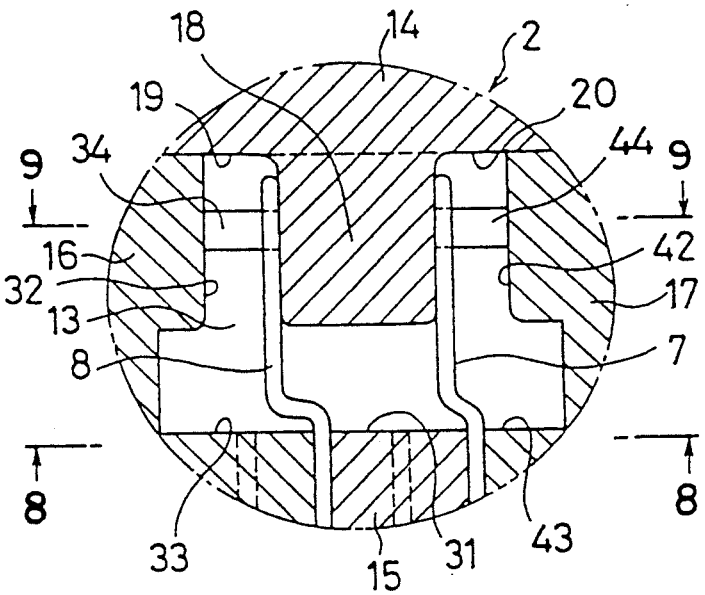
FIG. 7 is a sectional view of molds for forming the electrical connector according to an embodiment of the invention.
Figure 8:
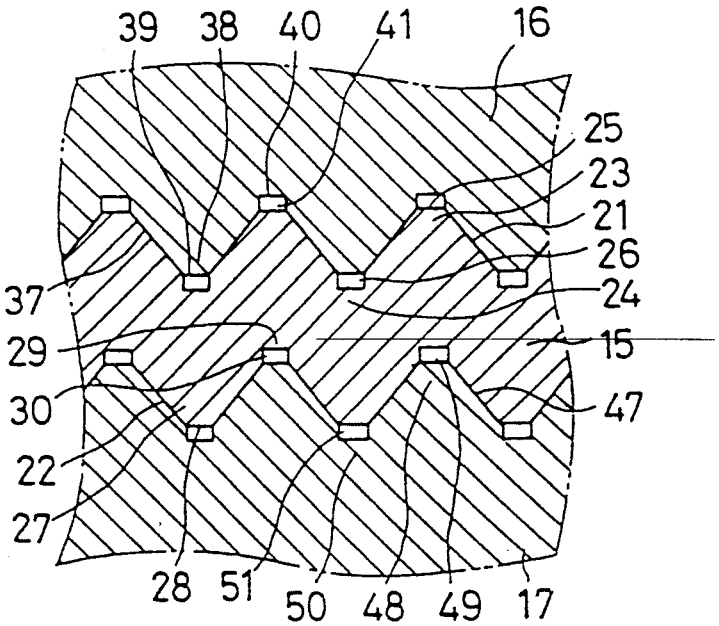
FIG. 8 is a sectional view taken along line 8—8 of FIG. 7.
Figure 10:
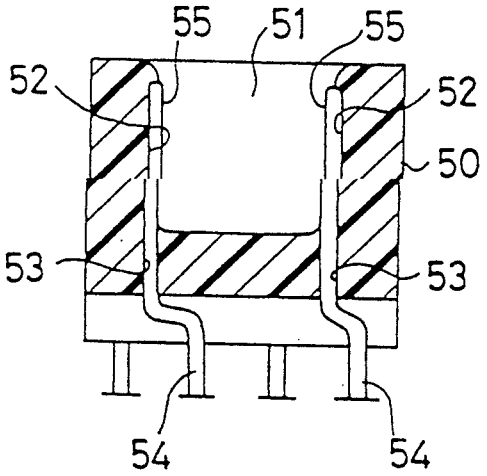
Prior Art FIG. 10
FIG. 10 is a sectional view of a conventional
Figure 12:
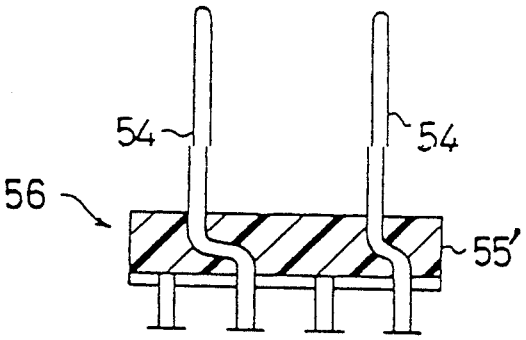
Prior Art FIG. 12
FIG. 12 is a sectional view of an insulating base of the conventional connector.
Figure 13:
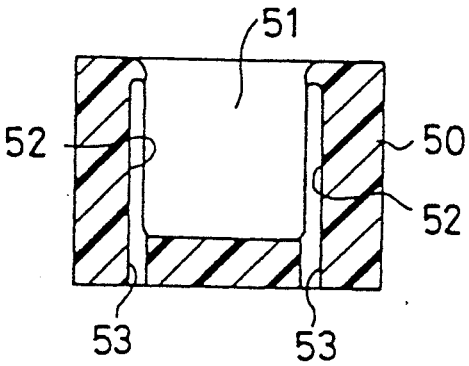
Prior Art FIG. 13
FIG. 13 is a sectional view of an insulating case of the conventional connector.
Figure 11:
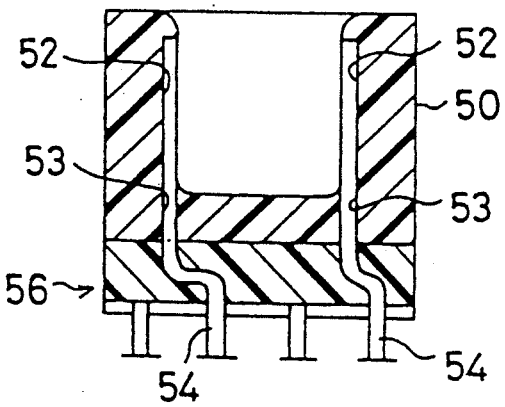
Prior Art FIG. 11
FIG. 11 is a sectional view of another
Figure 14:
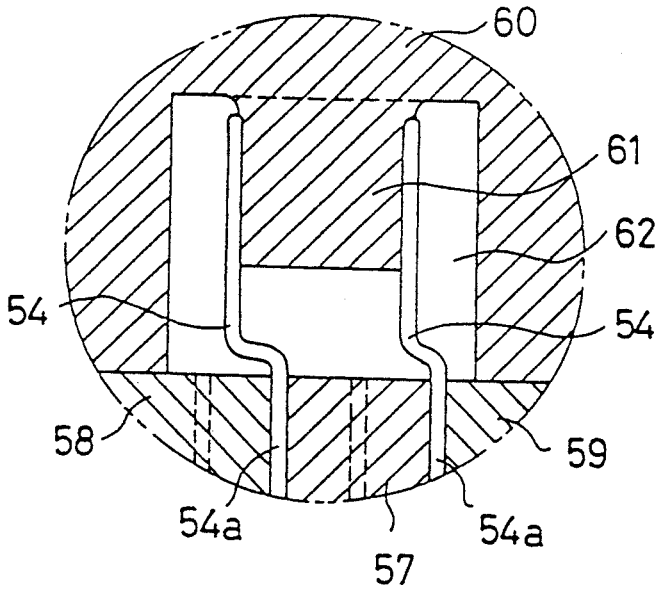
Prior Art FIG. 14
FIG. 14 is a sectional view of conventional molds for forming the electrical connector of FIG. 10.
Figure 15:
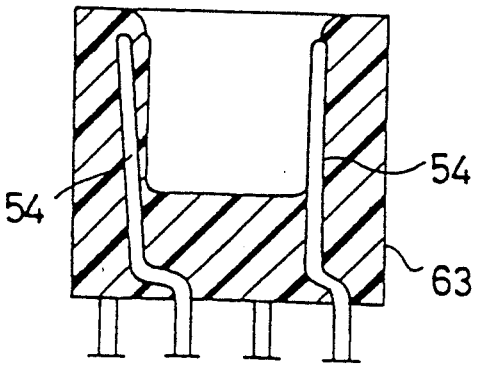
Prior Art FIG. 15
FIG. 15 is a sectional view of an electrical connector formed in the conventional molds.

A method of making the above connector plug will be described with reference to FIGS. 7-9.

The metallic molds 2 are composed of an upper mold 14, a lower mold 15, and a pair of slide molds 16 and 17. The upper mold 14 has a protruded portion 18 for determining the distance between the support walls 5 and 6 and forming surfaces 19 and 20 for forming the top faces 5*a* and 6*a*. The lower mold 15 has a pair of zigzag side walls 21 and 22 which have flat faces 25 and 28 on the peaks 23 and 28 and rectangular grooves 26 and 30 on the valleys 29 and 29, respectively. The lower mold 15 also has a top face 31 for forming the bottom of the insulating case 3 between the terminals 7 and 8.

The left-side slide mold 16 has a forming surface 32 for forming an outside of the support wall 5 and a forming surface 33 for forming the bottom of the insulating case 3 to the left of the terminals 7 and 8. A number of terminal guides 34 extend from the forming surface 32 at predetermined intervals along the wall and have a pair of notches 35 to form terminal holders 36. The slide mold 16 has a zigzag side wall 37 which has flat faces 39 on the peaks 38 and rectangular grooves 41 on the valleys 40.

Similarly, the right-side slide mold 17 has a forming surface 42 for forming the outside of the right-hand support wall 6 and a forming surface 43 for forming the bottom surface of the insulating case 3 to the right of the right-hand terminals 7 and 8. A number of terminal guides 44 extend from the forming surface 42 at predetermined intervals and have a pair of notches 45 at the free end to form terminal holders 46 between adjacent ones. The slide mold 17 has a zigzag side wall 47 which has flat faces 49 on the peaks 48 and rectangular grooves 51 on the valleys 50.

The zigzag side walls 21, 22, 37, and 47 of the lower mold 15, and the left- and right-side slide molds 16 and 17 are joined together so that the flat faces 25, 28, 39 and 49 abut on the leg portions 12*a* and 12*b* of the terminals 7 and 8 within the terminal grooves 26, 30, 41 and 51 to retain the left- and right-side terminals 7 and 8. The upper mold 14 is set in the slide molds 16 and 17 such that the protruded portion 18 is placed between the left-and right-side terminals 7 and 8 and abut on the terminal guides 34 and 44, forming terminal holders 36 and 46 which hold the contact portions 10*a* and 10*b* of the terminals 7 and 8. Thus, the terminals 7 and 8 are fixedly held within the molds 2 at both the leg portion 12*a* and 12*b* and the contact portion 10*a* or 10*b*. Under these conditions, a molding material is injected into the mold cavity 13 for molding a connector plug 1 (FIG. 3).

The terminal guides 34 and 44 hold the contact portions 10*a* and 10*b* of the terminals 7 and 8 in cooperation with the protruded portion 18 to prevent the outward and/or sideways movement of the terminals 7 and 8, thus not only preventing the terminals 7 and 8 from being embedded within the insulating case 3 but also facilitating the production of precisely molded electrical connectors.

What is claimed is:

1. An electrical connector comprising:

an insulating case having a base and a pair of support walls extending upwardly from said base; and a plurality of electrical terminals joined with said insulating case by integral molding such that straight contact portions of said electrical terminals are embedded on the insides of said support walls;

said support walls provided with a plurality of T-shaped cavities each formed between adjacent electrical terminals for receiving terminal guides, thereby making it possible to hold said terminals from all directions during said integral molding.

2. A one-piece electrical connector made by joining a pair of slide molds with a lower mold to hold leg portions of electrical terminals between them and support straight contact portions of said electrical terminals with terminal guides each provided with notches on opposite front corners, thereby supporting said electrical terminals from three directions; setting an upper mold over said slide molds such that a protruded portion of said upper mold is inserted between rows of said straight contact portions to hold said electrical terminals from a fourth direction, thereby positioning precisely said electrical terminals in a mold cavity; and injecting a molding material into said mold cavity for molding.

* * * * *